US006224519B1

(12) United States Patent
Doolittle

(10) Patent No.: US 6,224,519 B1
(45) Date of Patent: May 1, 2001

(54) WEIGHT LIFTING MACHINE WITH ELECTROMAGNETIC COUPLERS

(76) Inventor: Matthew Doolittle, 1252 Hearthstone Ct., Holland, MI (US) 49423

( * ) Notice: Subject to any disclaimer, the term of this patent is extended or adjusted under 35 U.S.C. 154(b) by 0 days.

(21) Appl. No.: 09/049,768

(22) Filed: Mar. 27, 1998

(51) Int. Cl.[7] ..... A63B 21/065

(52) U.S. Cl. ..... 482/98; 482/99; 482/5; 482/9

(58) Field of Search ..... 482/5, 9, 98–103

(56) References Cited

U.S. PATENT DOCUMENTS

| | | | | |
|---|---|---|---|---|
| 3,635,472 | | 1/1972 | Marcyan . | |
| 3,912,263 | | 10/1975 | Yatso . | |
| 4,610,449 | | 9/1986 | Diercks, Jr. . | |
| 4,627,615 | | 12/1986 | Nurkowski . | |
| 4,746,113 | | 5/1988 | Kissel . | |
| 5,037,089 | | 8/1991 | Spagnuolo . | |
| 5,350,344 | | 9/1994 | Kissel | 482/98 |
| 5,476,428 | | 12/1995 | Potash et al. | 482/5 |
| 5,643,151 | * | 7/1997 | Naimo | 482/98 |
| 6,015,367 | * | 1/2000 | Scaramucci | 482/5 |

FOREIGN PATENT DOCUMENTS

| | | | | |
|---|---|---|---|---|
| 225914 | | 8/1985 | (DE) . | |
| 2613237 | * | 10/1908 | (FR) | 482/99 |
| 469457 | | 5/1975 | (SU) . | |
| 1172569 | | 8/1985 | (SU) . | |
| 1461483 | | 2/1989 | (SU) . | |

* cited by examiner

*Primary Examiner*—John Mulcahy
(74) *Attorney, Agent, or Firm*—Van Dyke, Gardner Linn & Burkhart, LLP

(57) ABSTRACT

A weight lifting machine provides an instantaneous variable resistance, which can be adjusted manually during a workout routine or through a program, which has been selected by the user prior the workout routine. The weight lifting machine includes a pair of guides and a stack of weights which are slidably mounted on the guides and movable along the guides from a rest position to an elevated position. The weight lifting machine also includes a selector member and a lift member. Each of the weights includes an opening to receive the selector member. The openings are aligned to define a transverse passage through the stack of weights to allow the selector member to couple to each of the weights in the stack. The selector member includes a plurality of couplers which are adapted to instantaneously couple to and decouple from respective weights of the stack of weights. The lift member, which is coupled to the selector member, is adapted to permit a user of the weight lifting machine to pull and thereby raise the weights coupled to the selector member from their respective rest positions to their respective elevated positions. In preferred form, the couplers comprise electromagnetic couplers, with each of the electromagnetic couplers being adapted to be selectively energized and de-energized for coupling to and decoupling from a respective weight in the stack of weights.

18 Claims, 7 Drawing Sheets

WEIGHT LIFTING MACHINE WITH ELECTROMAGNETIC COUPLERS

TECHNICAL FIELD AND BACKGROUND OF THE INVENTION

The present invention relates to a weight lifting machine and, more particularly, to a weight lifting machine which permits the user to select a sequence in which the weight is increase or decreased at various intervals during the workout routine or permits the user to adjust the weight during the workout routine without dismounting the machine.

Conventional weight lifting machines comprise a frame which includes a pair of spaced apart generally vertical tracks with a plurality of weights and a carriage movably mounted on the tracks. The carriage typically includes a select post or bar which extends through the central portions of the weights and is manually coupled to one or more of the weights to increase or decrease the weight coupled to the carriage. Typically, the weights are coupled to the select bar by a removable pin which extends through the weight and through a corresponding aperture in the select bar. The carriage also is connected to a cable on the distal end of which is connect a handle bar, with the cable being supported on the frame by a pair of pulleys. Therefore, when the user of the machine pulls on the handle bar the carriage moves up the tracks, with the resistance being a function of the number of weights that are coupled to the carriage. In order to vary the weight on the carriage, and therefore the resistance for the user of the machine, the user of the machine must return the carriage to the starting position and relocate the pin either to reduce the number of weights attached to the select bar or increase the number of weights attached to the select bar.

In some machines the adjustment requires the user to demount the machine. Furthermore, the adjustment requires a break in the routine and may prevent the user from reaching his or her optimal workout. As it is known in the weight lifting art, the key to obtaining maximum muscle building is to push the muscle beyond its normal everyday demands. Since muscle can recover some of its strength in a short duration, the user of the exercise machine may not achieve his or her maximum fatigue point when his or her exercise routine includes pauses when for example the user needs to change the weight.

More recently, exercise devices have incorporated variable resistance capabilities which allow the user of the exercise machine to maximize his or her benefits from the machine. For example, in U.S. Pat. No. 5,037,089 to Spagnuolo weights are selected by mechanical actuators which are controlled by the user of the exercise machine. The mechanical actuator includes a solenoid and a pin, which is held in place by a spring. When the solenoid is energized, the pin is withdrawn from the weight which reduces the resistance for the user of apparatus. The solenoids are controlled by a module which includes a microprocessor which permits the user of the equipment to increase or decrease the weight as desired. However, these actuators still rely on pins extending into and out of the selector bar. Therefore, the decoupling and coupling is not instantaneous. Moreover, there may be increased potential for jams, which result from misalignment of the pins with the select bar. Because these type of jams can not be manually fixed, there is an even greater potential for interruption.

Accordingly, there is a need for a weight lifting machine which allows the user of the machine to instantly vary the resistance during a workout and, further, to choose a pre-programmed workout, which does not include transition delays associated with the pin couplers.

SUMMARY OF THE INVENTION

Accordingly the present invention provides a weight lifting machine which includes a at least one guide and a stack of weights which are slidably mounted on the guide and movable along the guide from a rest position to an elevated position. The weight lifting machine also includes a selector member and one of a lift cable and a lift bar. Each of the weights includes an opening to receive the selector member. The openings are aligned to define a transverse passage through the stack of weights to allow the selector member to couple to each of the weights in the stack. The selector member includes a plurality of couplers which are adapted to instantaneously couple to and decouple from respective weights in the stack of weights, and the lift cable, which is coupled to the selector member, is adapted to permit a user of the weight lifting machine to pull the lift cable or the lift bar and thereby raise the weights coupled to the selector member from their respective rest positions to their respective elevated positions.

In one form, the couplers comprise electromagnetic couplers, with each of the electromagnetic couplers being adapted to be selectively energized and de-energized for coupling to and decoupling from a respective weight in the stack of weights.

In other forms, the lift cable or the lift bar is coupled to a handle, which the user can grasp to move a selected weight or weights from the rest position to the elevated position. The machine preferably includes a frame, which supports the lift cable or the lift bar and the guide. For example, the lift cable may be supported on the frame by at least one pulley. Furthermore, the frame may include a seat on which the user may sit when using the machine.

In yet further forms, the machine preferably includes a control module, which is electrically coupled to each of the electromagnetic couplers. The control module provides electrical current to the electromagnetic couplers for selectively energizing the electromagnetic couplers to respective weights on the stack of weights. Furthermore, the machine may include a sensor for detecting when at least one of the weights has been lifted from its respective rest position to its respective elevated position to determine the number of repetitions that have been completed, with the sensor being in communication with the control module and providing input into the control module.

As will be understood from the foregoing, the weight lifting machine of the present invention provides for instantaneous changes in resistance. Furthermore, the present invention allows the user the machine to pre-select or pre-program a workout routine and yet provide the user with a manual override option. Moreover, by provide remote control of the coupling and decoupling of weights to the selector member, the exercise machine can be reconfigured as desired to optimize the mechanical arrangement of the lift cable and the like.

These and other objects, advantages, purposes and features of the invention will become more apparent from the study of the following description taken in conjunction of the drawings.

DESCRIPTION OF THE PREFERRED EMBODIMENTS

Figure 1:
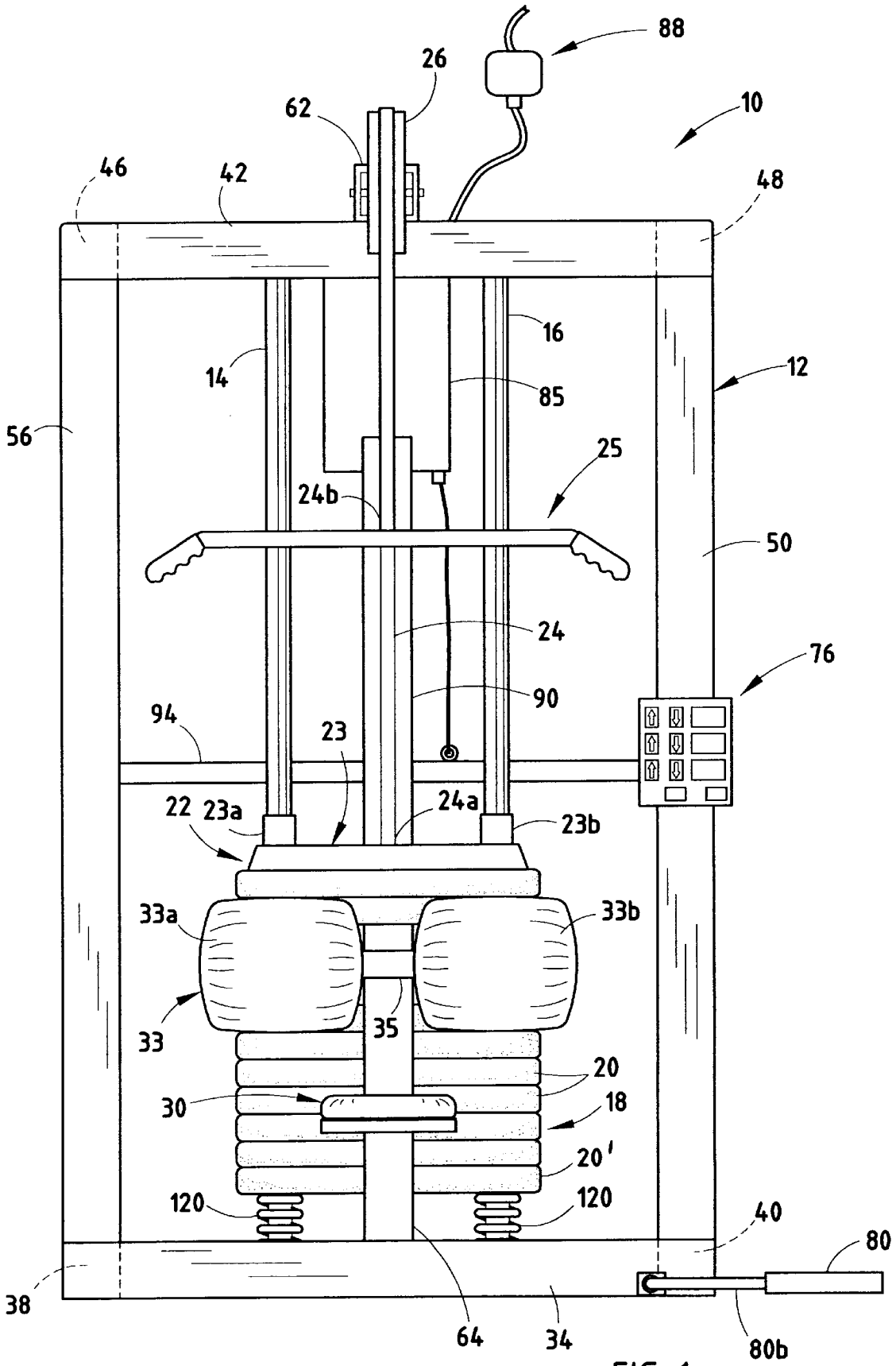
FIG. 1 is a front elevation of the weight lifting machine of the present invention.

Referring to FIG. 1, a weight lifting or exercise machine 10 is shown which includes a frame 12 that supports a pair of generally vertically oriented guide rods or rails 14 and 16 on which a stack of weights 18 and a carriage 22 are moveably mounted. As will be described in more detail below, the individual weights 20 of stack 18 are selectively coupled and decoupled from carriage 22 to increase or decrease the resistance for the user of machine 10.

Carriage 22 comprises a base member 23 which includes a pair of spaced apart bushings or bearings 23*a* and 23*b*, for example linear bearings. Bushings 23*a* and 23*b* define transverse passages through base 23 and guide carriage 22 on guide rods 14 and 16. Mounted to base 23 of carriage 22 is a lift member or lift cable 24. Lift cable 24 is secured at one end 24*a* to carriage 22 by a coupler 24*b*, including for example a threaded coupler, and secured to a handle 25 at a second end 24*b*. Lift cable 24 extends from carriage 22 upwardly through frame 12 and over a pair of spaced apart cable pulleys 26 and 28 which position handle 25 over a workout bench or seat 30. In this manner when handle 25 is pulled downwardly, carriage 22 and any weights 20 which are coupled to carriage 22 move up guide rods 14 and 16, with the resistance on the handle being a function of the number of weights coupled to the carriage 22.

Figure 2:
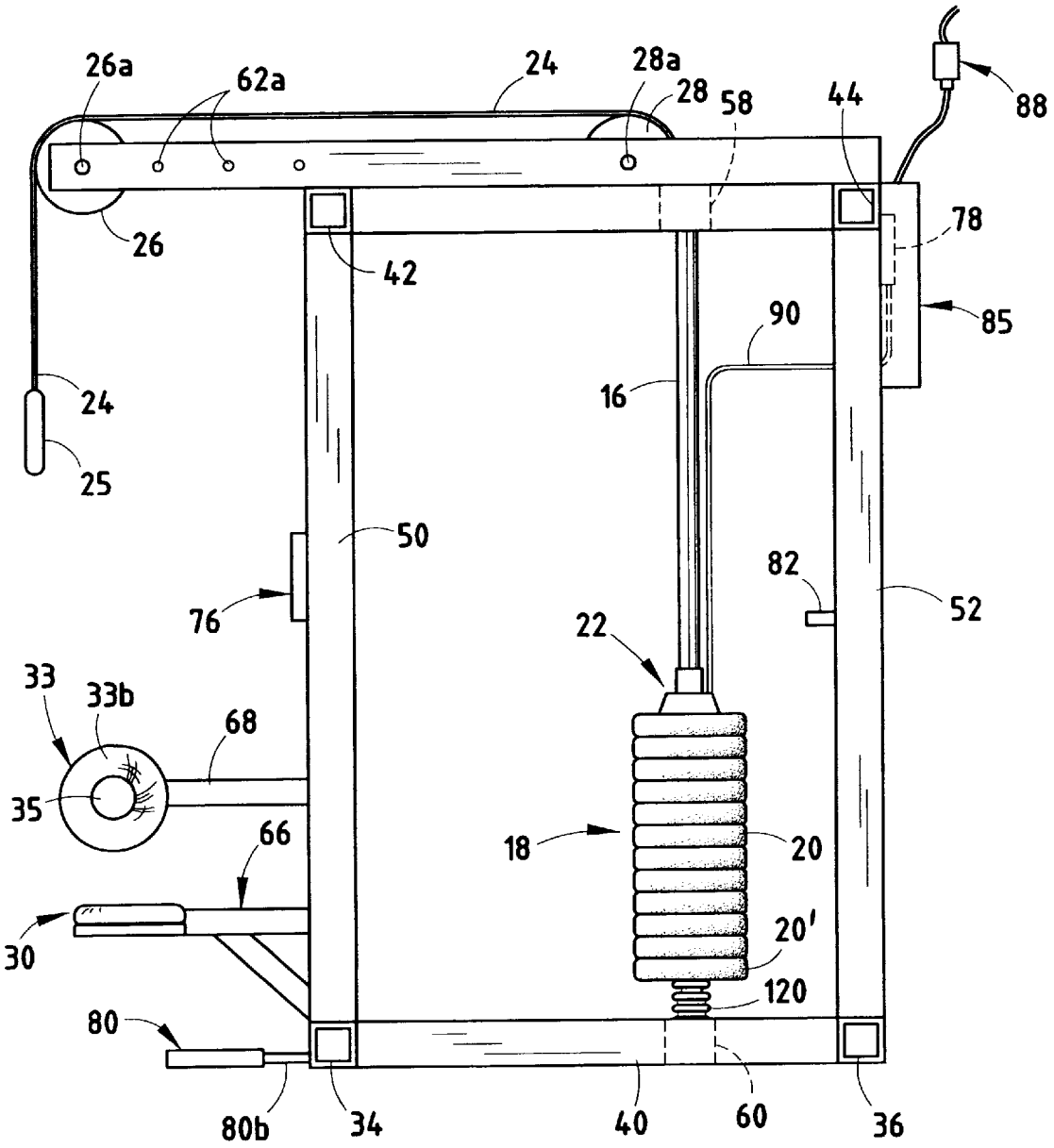
FIG. 2 is a side elevation of the weight lifting machine of FIG. 1.
Figure 3:
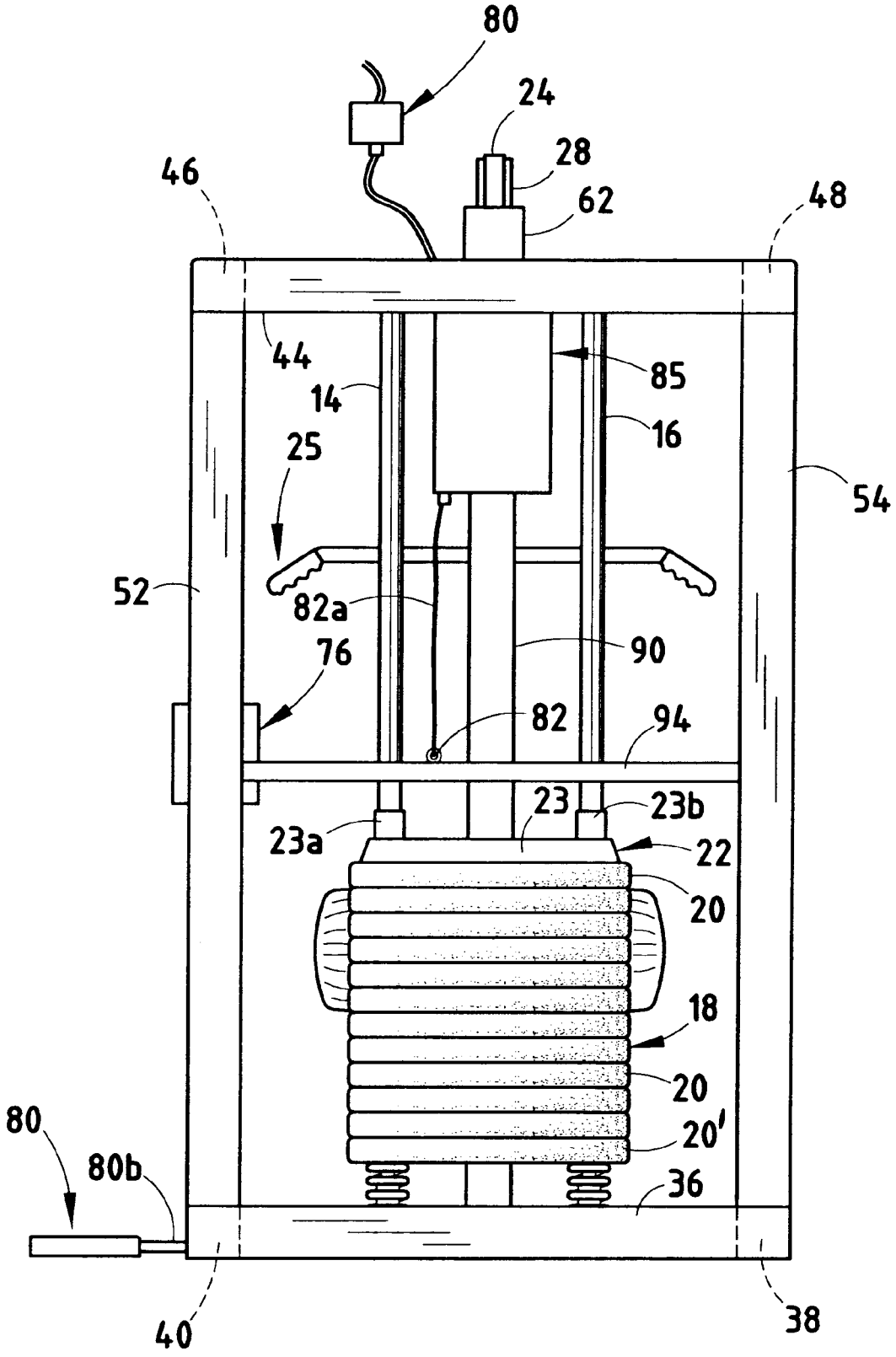
FIG. 3 is a rear elevation view of the weight lifting machine of FIG. 1.

Referring to FIGS. 1–3, frame structure 12 includes a pair of horizontally spaced front and back base members 34 and 36 which are interconnected by opposed side base members 38 and 40. Frame structure 12 further includes front and back upper members 42 and 44 which are similarly interconnected by opposed side upper members 46 and 48 and which are further interconnected to base members 32, 34, 36, and 38 by a plurality of column members 50, 52, 54, and 56, which form a rigid frame and support guide rods 14 and 16. Guide rods 14 and 16 are mounted to upper members 46 and 48 by a transverse cross member 58 which extends between upper members 46 and 48 on one end and are similarly mounted to base members 38 and 40 by a lower transverse member 60 which extends between lower base members 38 and 40. Pulleys 26 and 28 are respectfully rotatably supported on frame 12 by a cantilever support member 62 which is mounted to upper members 42 and 44. Pulleys 26 and 28 are rotatably mounted on member 62 by pins 26*a* and 28*a*, respectively, which extend through transverse holes 62*a* provided in member 62. It can be appreciated, in this manner at least the location of pulley 26 can be adjusted to accommodate different weight lifting configurations.

As best seen in FIGS. 1 and 2, seat 30 is positioned forwardly of frame 12 and is supported from a vertical intermediate frame member 64 which is secured to front base member 34. Seat 30 is preferably supported from vertical member 64 by a braced cantilever member 66. In addition to seat 30, exercise machine 10 may include a leg restraint 33. Leg restraint 33 is positioned forward of seat 30 so that the user can restrain himself or herself from lifting off seat 30 when working out with a weight that exceeds his or her own body weight. Restraint 33 includes a pair of cylindrical padded members 33*a* and 33*b* which are rotatably mounted on a tubular member 35 which is similarly mounted to vertical support or member 64 by a cantilever member 68. Preferably, both seat 30 and restraint 33 are adjustably mounted to vertical support 64 to accommodate users of different height and proportions. In this manner, when a user is seated on seat 30, the user may position his or her legs under restraint 33 and pull on handle 25 which in turn pulls on carriage 22 by way of lift cable 24. As described previously, the amount of resistance depends on the number of individual weights 20 that are coupled to carriage 22.

Figure 4:
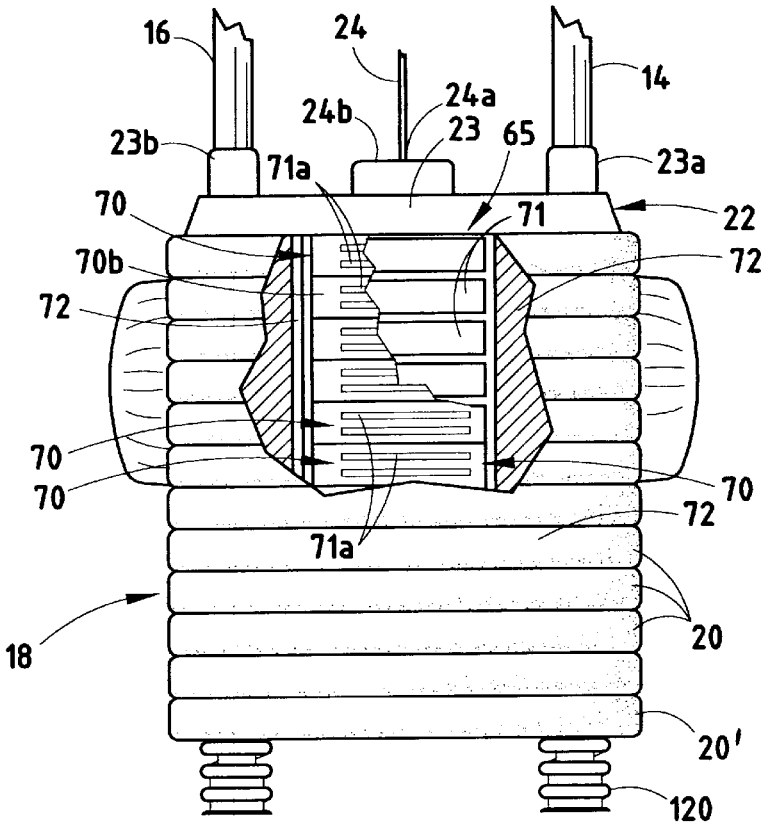
FIG. 4 is an enlarged partial fragmentary elevation of a stack of weights illustrating electromagnetic couplers mounted to a selection rod for selectively coupling a respective weight to the selection rod.
Figure 5:
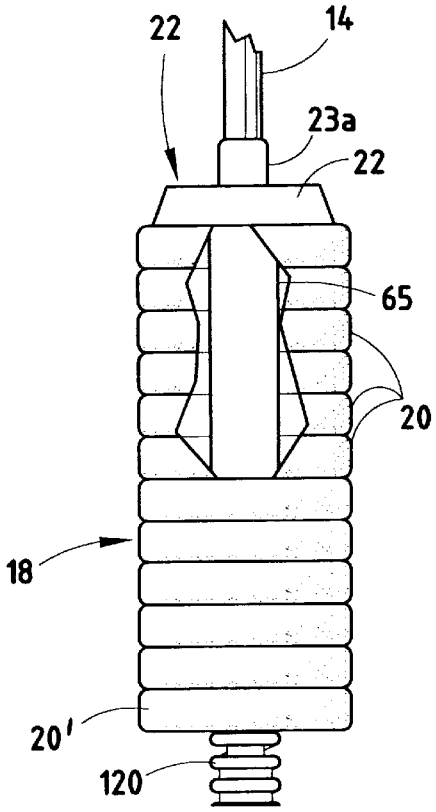
FIG. 5 is a side elevation of the selection rod with the electromagnetic couplers mounted thereto.

As best seen in FIG. 4, carriage 22 includes downwardly depending selection rod or member 65 in which a plurality of electromagnetic couplers 70 are positioned or mounted. In preferred form, selection rod 65 includes a plurality of cavities 71, which can be milled, cast or formed from welded components forming selection rod 65, in which electromagnetic coils 71*a*, which form electromagnetic coupler 70, are held in a respective cavity 71 by an adhesive, such as an epoxy potting material. Referring to FIGS. 4 and 5, selection rod 65 extends through central openings 72 provided in weights 20 and includes a respective electromagnetic coupler 70 for each individual weight 20 in stack 18 so that each weight can be individually and selectively coupled to selection rod 65. Given the high tensile force, on the order of 1200 lbs, of the individual electromagnetic couplers 70, only one exposed side or face 70*b* of electromagnetic couplers 70 are needed to hold the respective weights 20. However, it should be understood that more than one side of electromagnetic couplers 70 may be exposed for holding the respective weights. Alternatively, electromagnetic couplers 70 may be mounted to selection rod by conventional means, such as fasteners or the like.

Electromagnetic couplers 70 are energized or de-energized through a control circuit 75, shown in FIG. 6, which will be more fully described below. In this manner, each respective electromagnetic coupler 70 can be individually activated or deactivated to couple to or decouple from its respective weight 20 in stack 18 to increase or decrease the weight coupled to carriage 22. Furthermore, the weights are instantaneously coupled or decoupled which eliminates any transition time between changes in the resistance. Consequently, the user of the weight lifting machine can work to his or her optimum fatigue point without resting.

Figure 6:
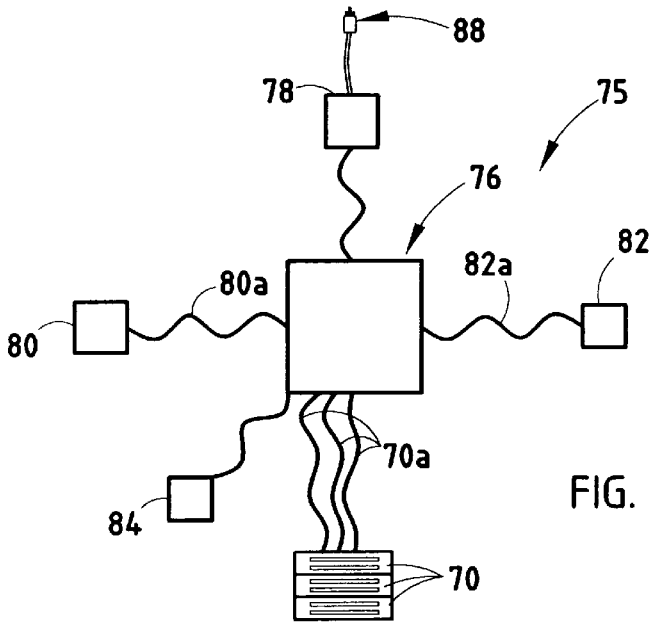
FIG. 6 is a schematic circuit diagram illustrating a control circuit for the electromagnetic couplers.

As best seen in FIG. 6, control circuit 75 includes a control center 76, which in turn includes a processor such as a microprocessor, and preferably a memory storage device, an AC to DC converter 78, a manual input control 80, such as a manual drop switch, and a proximity sensor 82. In the illustrated embodiment, converter 78 is supported in a housing 85 which is mounted to frame 12 on column member 52. Converter 78 is electrically coupled to a 110-volt AC power drop 88 through conventional wiring. Housing 85 includes a wire chase or harness 90 through which electrical wires extend from housing 85 to weight stack 18. Wires 70*a* extend along frame 12 or in the frame's (12) tubular members 52, 46, and 58 to housing 85 where they exit from housing 85 through wire chase 90. Wire chase 90 preferably extends through base 23 of carriage 22 and down through selection member 65 to electrically couple each electromagnetic coupler 70 to control center 76.

Figure 7:
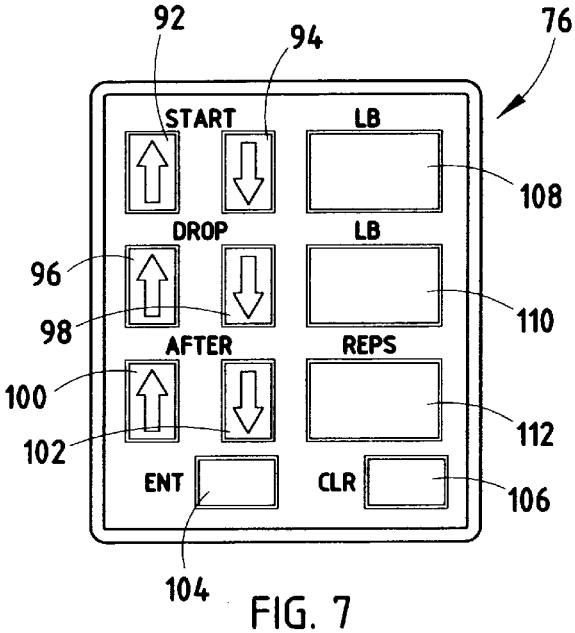
FIG. 7 is an enlarged view of an input control module for the control circuit.

Control center 76, which also includes manually operational buttons as described below, is preferably mounted to a forward portion of frame 12 which is easily accessible by the user of the machine, for example column member 50. Referring to FIG. 7, control center 76 preferably includes a touch pad having a plurality of buttons or touch pads 92 and 94 to increase or decrease the start weight, a pair of buttons or touch pads 96 and 98 to increase or decrease the drop weight, and a pair of buttons or touch pads 100 and 102 to increase or decrease the number of repetitions at which the drop weight occurs. Furthermore, control center 76 preferably includes an enter button 104 and a clear button 106 to start and to stop the sequence. Control module 76 also preferably includes a plurality of readouts 108, 110, and 112 either in analog or digital form, for example LCDs, to indicate the starting weight, drop weight, and the number of repetitions before the drop is automatically executed, which is selected by the user. In this manner, the user of the weight lifting machine 10 may manually select a program of varying weights for each workout. In addition, control circuit 75 preferably includes manual drop switch 80 which allows the user to drop one weight at a time. Preferably, manual drop switch 80 comprises a foot switch, which is easily accessible by the user of the machine, as shown in FIGS. 2 and 3. Manual drop switch 80 may be used in lieu of an auto drop weight input into control center 76 or may be used to override control center 76, for instance when the user has not yet reached the number of pre-set repetitions. In addition, control circuit 75 may include emergency drop switch 84, which can be mounted on handle 25, which provides for a quick release of all the weights 20 in the event of a cramp or other similar situations.

As best seen in FIG. 1, switch 80 may be coupled or mounted to base member 34 by a conduit 80*b* though which switch 80 is powered by conventional wiring. Conduit 80*b* may comprise a rigid conduit or a flexible conduit to permit repositioning of switch 80 as desired. Alternately, manual drop switch 80 can be located on handle 25. Manual drop switch 80 is preferably coupled to control center 76 and optionally can provide an override of the program which has been input into control center 76.

Referring again to FIG. 2, the respective electrical wiring 80*a*, 84*a*, and 82*a* for manual drop switch 80, emergency drop switch 84, and proximity switch 82 are preferably harnessed and extend through framework 12 and are directed by the frame members of frame 12 to control module 76. Optionally, frame members 34, 36, 38, 40, 42, 44, 46, 48, 50, 52, 54, and 56 comprise tubular members, which are welded together or otherwise rigidly interconnected and provide a conduit for electrical wiring 80*a*, 82*a*, and 84*a*, which respectively electrically connect manual switch 80, proximity sensor 82, and emergency switch 84 to control center 76. As described previously, electrical wiring 70*a* which couples electromagnetic couplers 70 to control center 76 are directed to control center 76 via wire chase 90.

Proximity sensor 82 is supported on frame 12 by a transverse support member 94, which extends between columns 52 and 54. Proximity sensor 82 provides input to control center 76 and determines the number of repetitions that have been completed so that the microprocessor can initiate a change in the weight. Proximity sensor 82 is, therefore, preferably mounted above the starting position of stack 18 so that when a weight is lifted above sensor 82 the sensor detects a repetition.

In order to reduce the impact on frame 12 when weights 20 are lowered to their respective starting positions, rails 14 and 16 preferably include springs 120 interposed between the lowermost weight 20' and transverse member 60.

It should be understood from the foregoing that when a user is seated on bench 30, the user may reach control center or module 76 to either select a preprogrammed sequence or select a program, which would provide a variable resistance over the duration of the workout, by using buttons 92, 94, 96, 98, 100, and 102. Furthermore, the user may use the manual drop switch 80 to manually drop the weight if the auto-drop sequence is not selected in control center 76.

Furthermore, it should be understood that weight lifting machine 10 permits the user to adjust the sequence of the workout without releasing handle 25 and, furthermore, without moving from seat 30, which is especially desirable for a new user or an occasional user who is unfamiliar with the resistance that best suited for him or her. In addition, by providing remote control of the couplers, the configuration of the seat, leg restraint, and handle may be optimized and provide for custom configurations. Thus, the configuration of the weight machine can be built in an optimal mechanical fashion rather than by the dictates or requirements of the weight stack.

Figure 8:
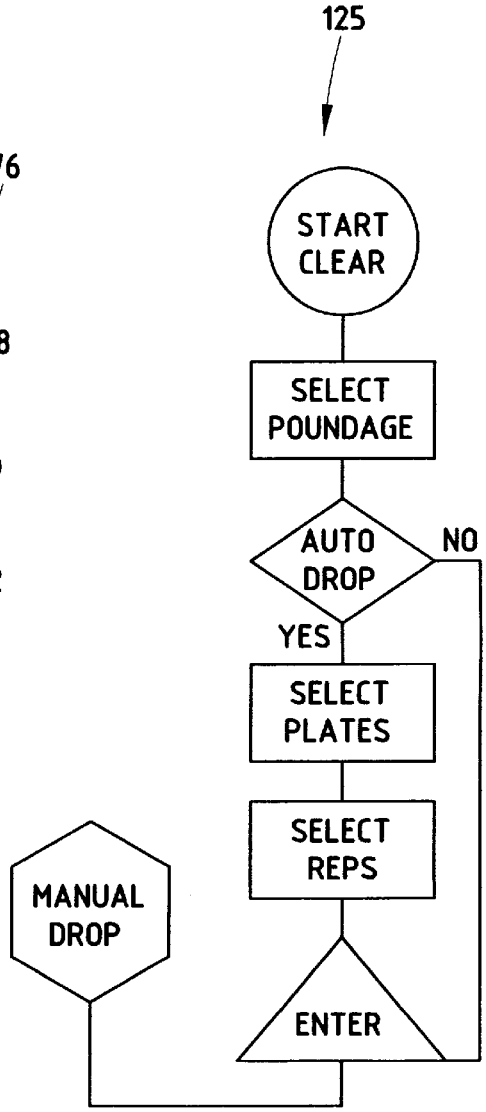
FIG. 8 is a flow chart of the control circuit for the weight lifting machine.

Referring to FIG. 8, a computer program 125 may be preprograms and stored in the control center memory storage device. Computer program 125 preferably includes an initial clear or start condition, in which all the electromagnetic couplers are de-energized. Then, the program 125 waits for a prompt from buttons 92 and 94 to select an initial or start weight. If no further input is given after the initial weight is selected, then a preprograms set will start with the start weight remaining constant through the workout cycle, unless manual drop switch 80 is used. However, if a drop weight is selected by the user, then the program will wait to receive input from buttons 100 and 102 for the number of repetitions which indicates when the drop weight is to be decoupled from the selection rod. It should be understood to those having ordinary skill in the art that the program can be varied and modified to provide other options and variations.

Figure 9:
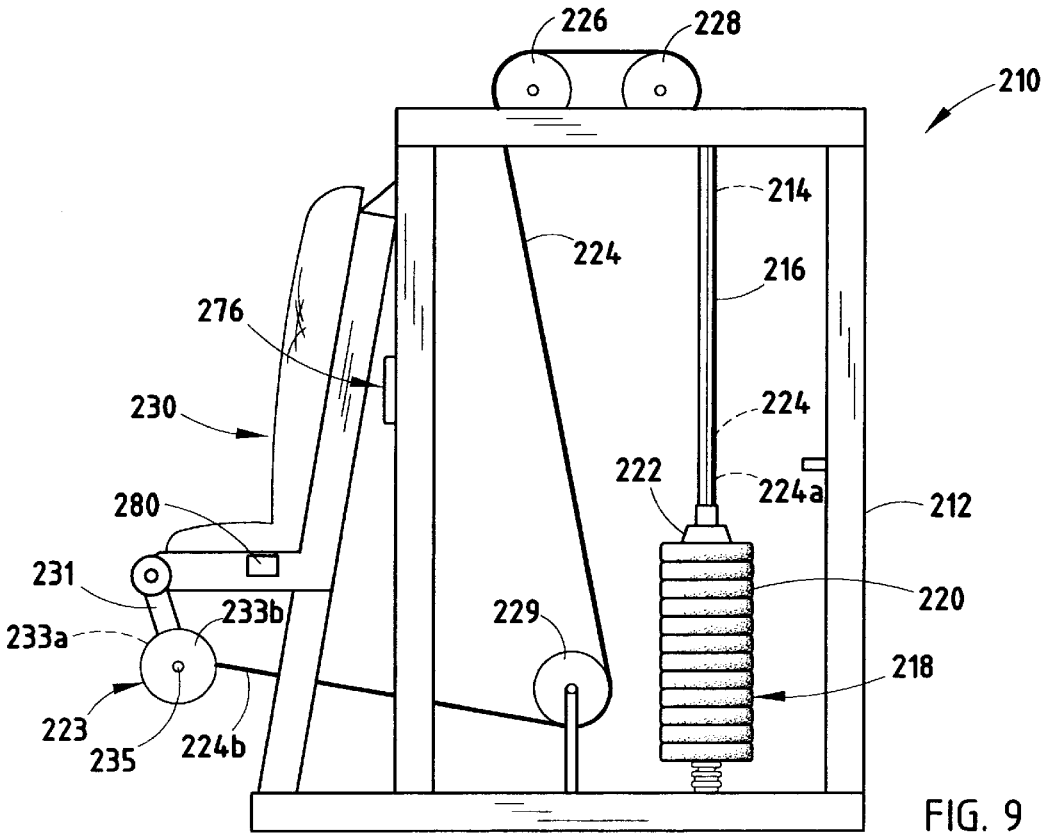
FIG. 9 is a side elevation of a second embodiment of the weight lifting machine of the present invention.

Referring to FIG. 9, a second embodiment 210 of an exercise machine is shown. Exercise machine 210 includes a frame 212 which supports a pair of generally vertical oriented guide rods or rails 214 and 216 in which a stack of weights 218 and a carriage 222 are moveably mounted. Reference is made to the first embodiment for details of carriage 222 and its respective selection rod and electromagnetic couplers (not shown). In this embodiment, a lift member or lift cable 224 is secured at one end 224*a* to carriage 222 and secured to an ankle pad 225 and a second end 224*b*. Cable 224 extends from carriage 222, similar to that previously described in reference to the first embodiment, upwardly through frame 212 and over a pair spaced apart cable pulleys 226 and 228 and extends downwardly behind a third cable pulley 229 which is supported on frame 212 and positioned to align second end 224*b* of lift cable 224 and ankle pad assembly 225.

Mounted to frame 212 is a seat 230. Seat 230 is positioned above ankle pad assembly 225 which is pivotally mounted to seat 230 by a pivotal arm 231. Preferably, ankle pad assembly 225 comprises a pair of cylindrical padded members 233*a* and 233*b* which are rotatably mounted on a tubular member 235. Tubular member 235 is mounted to the end portion of pivotal arm 231 so that when a user is seated on seat 230, the user's legs can extend behind cylindrical padded members 233*a* and 233*b* for positioning his or her feet behind the respective padded members 233*a* and 233*b*. When the user extends his or her legs and pushes against padded members 233*a* and 233*b* with his or her respective feet or ankles, arm 231 pivots with a resistance that is a function of the number of weights 220 coupled to the selector rod and to carriage 222. In this embodiment, both the control center 276 and a manual drop switch 280 may be mounted to frame 212 or seat 230 so that they are accessible and can be reached by the users hands. Reference is made to the first embodiment for preferred details of the control center and the control circuit.

Figure 10:
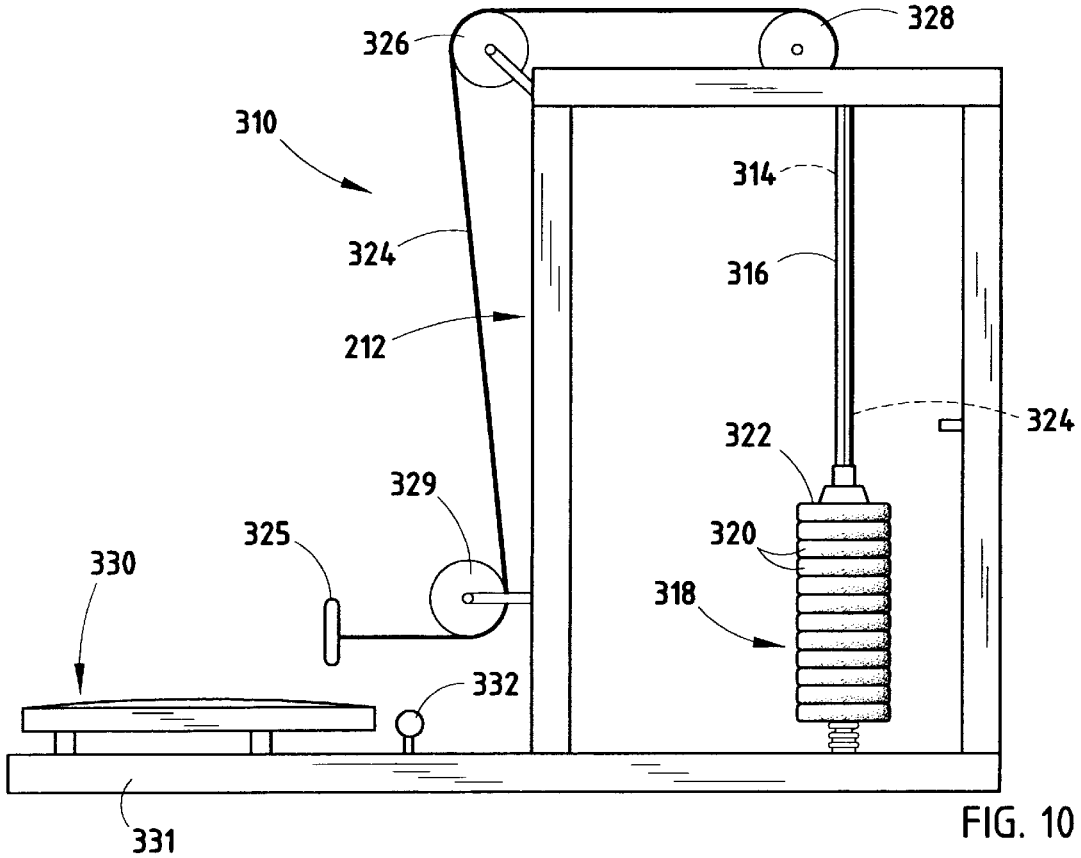
FIG. 10 is a side elevation of a third embodiment of the weight lifting machine of the present invention.

Referring to FIG. 10, a third embodiment 310 of the weight lifting or exercise machine is illustrated. In this embodiment, exercise machine 310 comprises a rowing-type exercise machine and includes a frame 312 which is configured to provide an upper and lower body workout. Frame 312 includes a pair of generally vertically oriented guide rods or rails 314 and 316 on which a stack of weights 318 and a carriage 322 are movably mounted. Similar to the first and second embodiments, the individual weights 320 of stack 318 are selectively coupled and decoupled from carriage 322 to increase or decrease the resistance of the user of the machine 310 by energizing or deenergizing the electromagnetic couplers provided or formed on the selection rod of the carriage.

For further details of carriage 322 and its selector rod and electromagnetic couplers (not shown) reference is made to the first embodiment. Exercise machine 310 includes a lift member or lift cable 324, which is secured at one end 324*a* to carriage 322 and secured to a handle 325 at a second end 324*b*. Lift cable 324 extends from carriage 322 upward through frame 312 and over a pair of spaced apart pulleys 326 and 328 and downwardly behind a third pulley 329 which is mounted to a lower but forward portion of frame 312 and which positions handle 325 over a sliding seat 330, for example a rowing seat. In this manner, when handle 325 is pulled outwardly from frame 312, any weights 320 which are coupled to carriage 322 move up guide rods 312 and 314, with the resistance on the handle being the function of the number of weights coupled to the carriage 322.

Referring again to FIG. 10, secured to frame structure 312 is a seat frame 331. Seat frame 331 supports sliding seat 330 and includes a foot restraint 332 so that when the user is seated on seat 330, the user can lock his or her feet in position at the foot restraint while pulling on handle 325 such that the users can slide along seat frame 331 and move his or her legs from a folded position to a fully extended position to engage in a rowing exercise.

Figure 11:
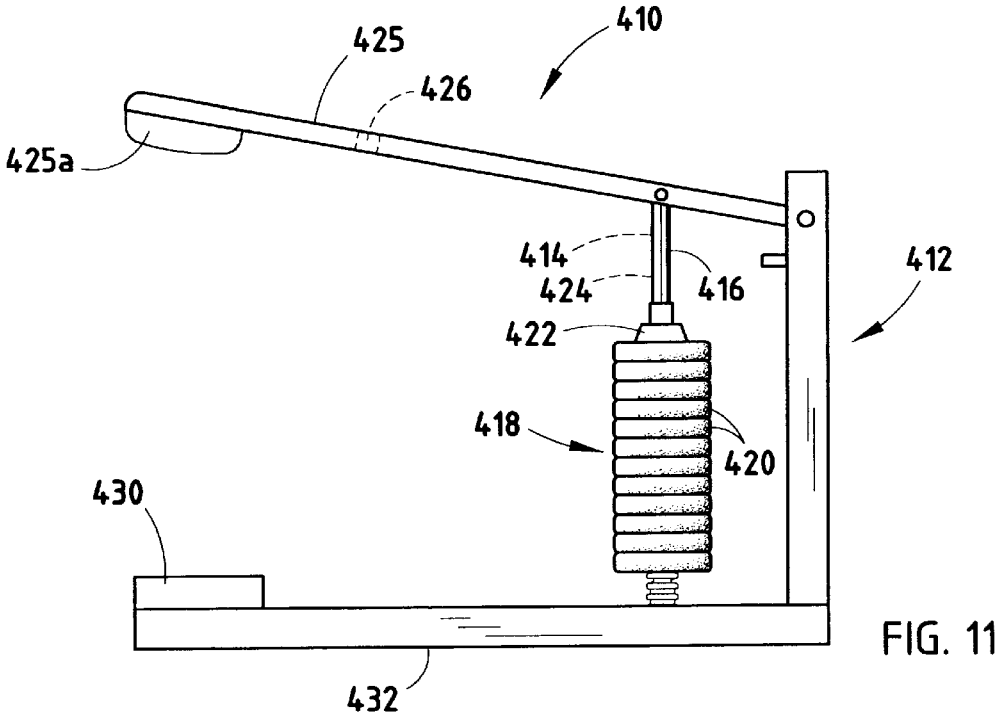
FIG. 11 is a side elevation of a fourth embodiment of the weight lifting machine of the present invention.

Referring to FIG. 11, a third embodiment 410 of weight lifting or exercise machine is illustrated. In this embodiment, weight lifting machine comprises a calf exerciser and includes a frame 412 with a foot rest 430 which is secured to a base member 432 of frame 412. Frame 412 also includes a pair of generally vertically oriented guide rods or rails 414 and 416 in which a stack of weights 418 and a carriage 422 are movably mounted. The individual weights 420 of stack 418 are selectively coupled and decoupled from carriage 422 to increase or decrease the resistance of the user of the machine 410, in a similar manner to that described in reference to the first embodiment. Therefore, reference to the first embodiment is made for further details of weights 420 and carriage 422 including its selector bar (not shown) and the control circuit which activates or deactivates the electromagnetic couplers on the selector bar.

Mounted to base 423 of carriage 422 is a lift member 424, such as a lift cable, lift chain, or lift rod or bar. Lift member 424 is secured at one end to carriage 422 and pivotally secured at its second end to a lift arm 425, which in turn is pivotally mounted to frame 412. Mounted or secured to the free end of lift arm 425 is a shoulder pad 425*a*. In this manner, a user of exercise machine 410 stands on foot pad 430 and places shoulder pads 425*a* on his or her shoulders. As the user pivots about his or her ankles, the user extends and contracts his or her calf muscles with a resistance that is a function of the number of weights 420 which are coupled to carrier member 422. It should be understood that lift arm 425 preferably comprises a pair of spaced apart arm members, which are interconnected by intermediate transverse or bracing members 426. Additionally, shoulder pad 425*a* may comprise a single shoulder pad with a cut-out for the users neck or may comprise two spaced apart shoulder pads, which would allow the user's neck to be positioned between the respective shoulder pads, as would be understood by those having ordinary skill in the art.

Figure 12:
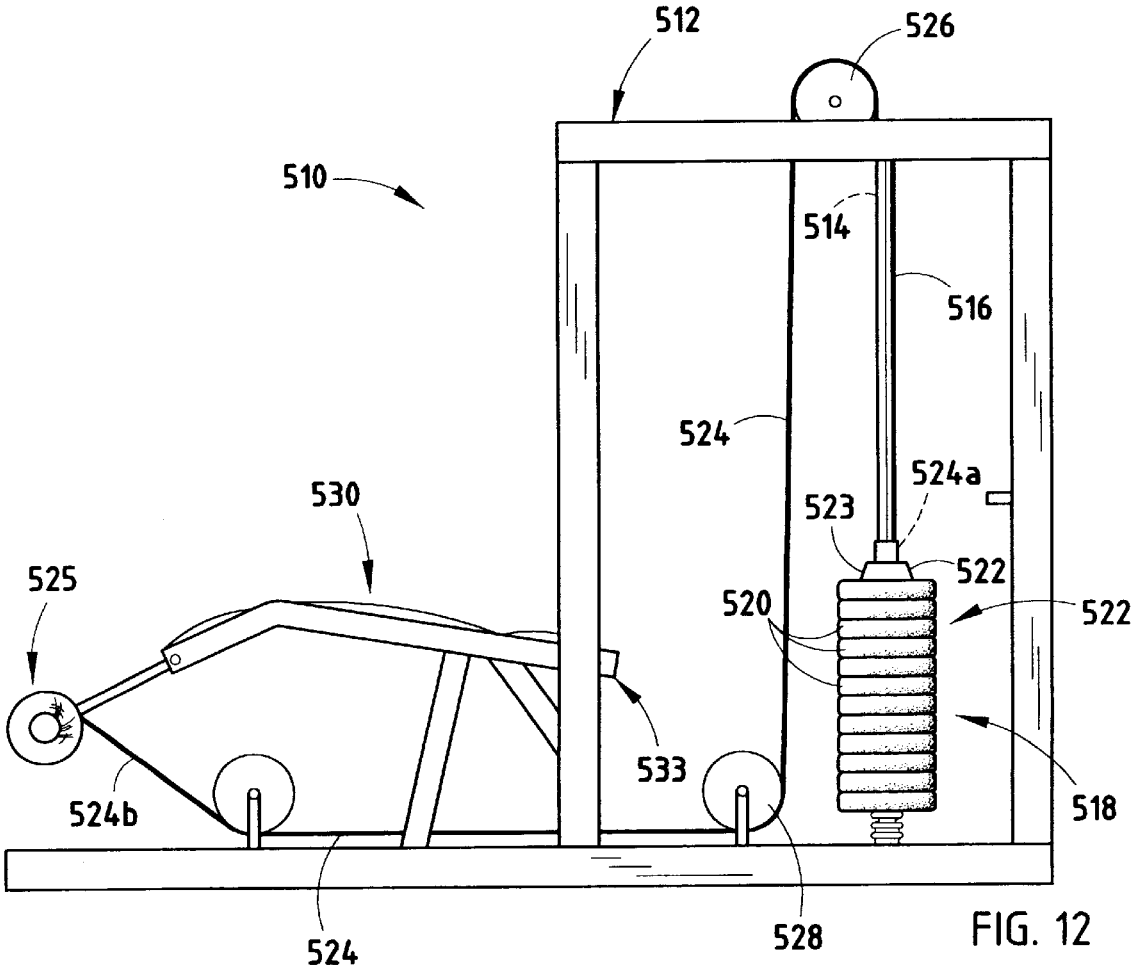
FIG. 12 is a side elevation of a fifth embodiment of the weight lifting machine of the present invention.

As best seen in FIG. 12, a fifth embodiment 510 of weight lifting or exercise machine is illustrated. In this embodiment, exercise machine 510 comprises a leg curl exercising machine and includes a frame 512 which supports a pair of spaced apart guide rails or guide rods 514 and 516 on which a stack of weights 518 and a carriage 522 are movably mounted. Individual weights 520 of stack 518 are selectively coupled and decoupled from carriage 522 to increase or decrease the resistance for the user of the machine by a plurality of electromagnetic couplers, as described in reference to first embodiment.

Mounted to base 523 of carriage 522 is a lift member or lift cable 524. Lift cable 524 is secured at one end 524*a* to carriage 522 and secured at a second end 524*b* to a foot or ankle pad assembly 525. Lift cable 524 extends upward through frame 512 and over a first pulley 526 supported on an upper member of frame 512 and then downwardly and outwardly below a second pulley 528 and third pulley 529, which are respectively supported on a base member 532 of frame 512 and which direct cable 524 to ankle pad assembly 525.

Frame 512 includes a bench or seat 530, which may be releasably coupled to frame 512 or integrally formed or rigidly coupled to frame 512. The user of machine 510 lays generally face downward with his or her legs extending beneath foot or ankle pad assembly 525. Foot or ankle pad assembly 525 is mounted to a support arm 525*a*, which is pivotally mounted to seat 530. In this manner, when a user of the machine 530 lays face down on seat 530 with his or her legs extending below ankle or foot pad assembly 525, the user can curl his or her legs to move foot pad assembly 525 from a first position wherein the users legs are fully extended to a second position wherein the users legs are curled. In this manner, the resistance experienced by the user is a function of the number of weights 520 which are coupled to the carriage 522, as described in reference to the first embodiment. Preferably, seat 530 includes a hand restraint 533 which enables the user of exercise machine 530 to restrain his or her upper body movement during an exercise routine.

Furthermore, while various forms of the invention have been shown and described, other forms are being apparent to those skill in the art. It should be understood that the general concept of a stack a weights with a selection member with a plurality of individually selectively activated electromagnetic couplers can also be used in other weight lifting configurations. Therefore, the embodiment of the invention shown in the drawings is not intended to limit the scope of the invention which is instead defined by the claims which follows.

I claim:

1. A weight lifting machine comprising:

a stack of weights, each of said weights having an opening, said openings being aligned to define a transverse passage through said stack of weights;

a pair of guides, each of said weights being slidably mounted on said pair of guides and being movable along said pair of guides from a rest position to an elevated position;

a selector member, said selector member having a downwardly depending member, said downwardly depending member supporting a plurality of couplers therein, said downwardly depending member having a transverse passage facing side, each of said couplers comprising an electromagnetic coupler having a transverse passage facing side, each of said electromagnetic couplers being positioned in said downwardly depending member such that said transverse passage facing side of said electromagnetic couplers are positioned in said transverse passage facing side of said downwardly depending member whereby each of said electromagnetic couplers has a single exposed side, and each of said electromagnetic couplers being adapted to be selectively energized or de-energized for magnetically coupling said single exposed side to or decoupling said single exposed side from a respective weight in said stack of weights; and one of a lift cable and a lift bar coupled to said selector member, said one of a lift cable and a lift bar being adapted to permit a user of said weight lifting machine to raise said weights coupled to said selector member from its respective rest position to its respective elevated position.

2. A weight lifting machine according to claim 1, further comprising a control module, said control module being electrically coupled to said electromagnetic couplers and providing electrical current to said electromagnetic couplers for selectively energizing said electromagnetic couplers.

3. A weight lifting machine according to claim 2, further comprising a sensor for detecting when at least one of said weights has been lifted from its respective rest position to its respective elevated position to determine the number of repetitions, said sensor being in communication with said control module and providing input into said control module.

4. A weight lifting machine according to claim 1, wherein said one of a lift cable and a lift bar is coupled to one of a handle, ankle pad assembly, and a shoulder pad.

5. A weight lifting machine according to claim 4, further comprising a frame, said one of a lift cable and a lift bar and said pair of guides being supported by said frame.

6. A weight lifting machine according to claim 5, wherein said one of a lift cable and a lift bar comprises a lift cable, said lift cable being supported on said frame by at least one pulley.

7. A weight lifting machine according to claim 5, further comprising a seat positioned below said handle, said seat being supported by said frame.

8. A weight lifting machine according to claim 1, wherein said selector member further includes a carriage, said downwardly depending member extending downwardly from said carriage, and said pair of guides extending through said carriage.

9. A weight lifting machine comprising:

a frame;

a stack of weights, each of said weights having an opening, said openings being aligned to define a transverse passage through said stack of weights;

a pair of guides supported by said frame, said weights being slidably supported on said pair of guides and being movable along said pair of guides from a rest position to an elevated position;

a selector member extending through said transverse passage, said selector member having a plurality of cavities formed therein and having a plurality of electromagnetic couplers, each of said electromagnetic couplers being positioned and recessed in a respective cavity whereby said electromagnetic couplers each have a single exposed side, and each of said electromagnetic couplers being adapted to be energized for magnetically coupling said single exposed side to a respective weight in said stack of weights; and a lift member supported by said frame, said lift member being coupled to said selector member and being adapted to permit a user of said weight lifting machine to raise said weights coupled to said selector member from said rest position to said elevated position.

10. A weight lifting machine according to claim 9, wherein said lift member comprising a lift cable.

11. A weight lifting machine according to claim 10, wherein said lift cable is supported by said frame on a pair of pulleys.

12. A weight lifting machine according to claim 9, further comprising a control module, said control module being electrically coupled to said electromagnetic couplers and selectively providing electrical current to a respective electromagnetic coupler to energize said respective electromagnetic coupler to couple said respective electromagnetic coupler to said selector member.

13. A weight lifting machine according to claim 12, further comprising a sensor for detecting when at least one of said weights has been lifted from its respective rest position to its respective elevated position to determine the number of repetitions, said control module being responsive to said sensor.

14. A weight lifting machine according to claim 13, further comprising a manual drop switch electrically coupled to said control module.

15. A weight lifting machine according to claim 14, wherein said lift member including a handle, said manual drop switch being mounted to one of said frame and said handle.

16. A weight lifting machine according to claim 9, wherein said pair of guides extend through said weights.

17. A weight lifting machine according to claim 16, wherein said pair of guides include springs, said springs being at least partially compressed when said weights are their respective rest positions.

18. A weight lifting machine according to claim 15, wherein said pair of guides comprise guide rods.

* * * * *